US007125015B2

(12) United States Patent
Hoberman et al.

(10) Patent No.: US 7,125,015 B2
(45) Date of Patent: Oct. 24, 2006

(54) TRANSFORMING PUZZLE

(75) Inventors: Charles Hoberman, 472 Greenwich St., New York, NY (US) 10013; Matthew Davis, Newtown, PA (US)

(73) Assignee: Charles Hoberman, New York, NY (US)

( * ) Notice: Subject to any disclaimer, the term of this patent is extended or adjusted under 35 U.S.C. 154(b) by 144 days.

(21) Appl. No.: 10/962,987

(22) Filed: Oct. 12, 2004

(65) Prior Publication Data

US 2005/0098947 A1 May 12, 2005

Related U.S. Application Data

(60) Provisional application No. 60/512,419, filed on Oct. 17, 2003.

(51) Int. Cl.
*A63F 9/08* (2006.01)

(52) U.S. Cl. ..... 273/153 S

(58) Field of Classification Search ..... 273/153 R, 273/153 S, 157 R

See application file for complete search history.

(56) References Cited

U.S. PATENT DOCUMENTS

| | | | | |
|---|---|---|---|---|
| 2,481,779 | A * | 9/1949 | Peterson | 273/153 S |
| 3,193,293 | A * | 7/1965 | Schaper | 273/153 R |
| 4,767,120 | A * | 8/1988 | Ho | 273/153 S |
| 4,780,344 | A | 10/1988 | Hoberman | |
| 4,942,700 | A | 7/1990 | Hoberman | |
| 4,981,732 | A | 1/1991 | Hoberman | |
| 5,024,031 | A | 6/1991 | Hoberman | |
| 5,100,142 | A * | 3/1992 | Cannata | 273/153 S |
| 5,234,727 | A | 8/1993 | Hoberman | |
| 5,301,943 | A * | 4/1994 | Asztalos | 273/153 S |
| 6,082,056 | A | 7/2000 | Hoberman | |
| 6,190,231 | B1 | 2/2001 | Hoberman | |
| 6,219,974 | B1 | 4/2001 | Hoberman | |
| 6,536,764 | B1 * | 3/2003 | Spitzer | 273/153 S |

(Continued)

*Primary Examiner*—Steven Wong
(74) *Attorney, Agent, or Firm*—Gottlieb, Rackman & Reisman

(57) ABSTRACT

A puzzle assembly is shown and comprises a multiplicity of geared links that are arranged such that their turning axes are oriented along the edges of a polyhedral shape so that when a single link is turned, all links turn synchronously. In the assembly, there are two end positions of the geared links. In each end position, a set of link groups are formed, each of those groups corresponding to one face of the polyhedral shape so that each link group forms a circular track that is inscribed on that particular face. When the puzzle assembly is moved to a second end position, a new set of new link groups is formed corresponding to a different a different set of faces of the polyhedral shape. The puzzle assembly further comprises a number of "petal elements" equal to the number of geared links. The petals have a faceted form and a base piece that extends from that form for providing a sliding contact with the geared links. Each petal element is retained by a geared link. When the puzzle assembly is in one end position, a group of petals corresponding to a polyhedral face touch each other to form a pyramidal shape. Thus, one-half of their surfaces are exposed and one-half of their surfaces are hidden. When the puzzle assembly is "flipped"—the geared links are turned to their other end position—the petals recombine to hide the previously visible surfaces and to reveal the previously invisible surfaces. Importantly, in either end position, the group of petals corresponding to a polyhedral face may be twisted around the center point of that face, thereby changing the correspondence between the geared links and the petal elements.

25 Claims, 9 Drawing Sheets

U.S. PATENT DOCUMENTS

| | | | |
|---|---|---|---|
| 6,739,098 | B1 | 5/2004 | Hoberman |
| 6,834,465 | B1 | 12/2004 | Hoberman |
| 2002/0083675 | A1 | 7/2002 | Hoberman |
| 2002/0112413 | A1 | 8/2002 | Hoberman |
| 2003/0037491 | A1 | 2/2003 | Hoberman |
| 2003/0097801 | A1 | 5/2003 | Hoberman |
| 2004/0134157 | A1 | 7/2004 | Hoberman |

* cited by examiner

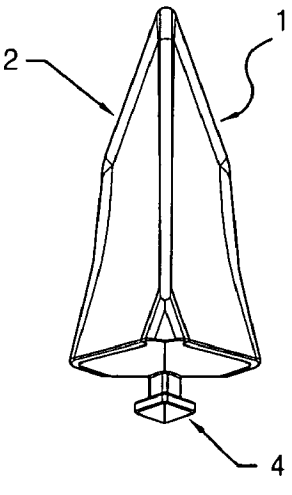
FIG.3
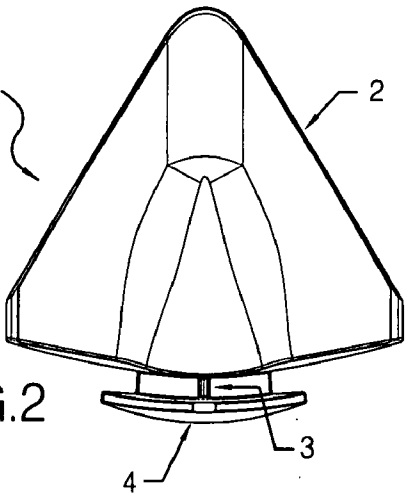
FIG.2
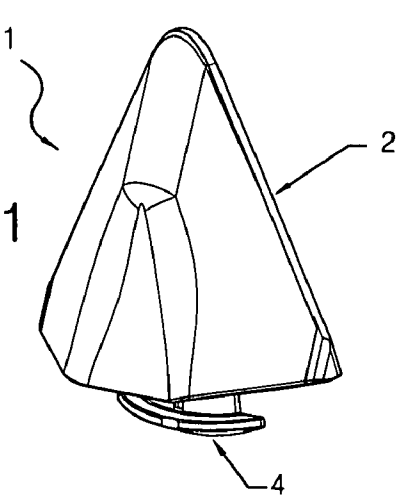
FIG.1
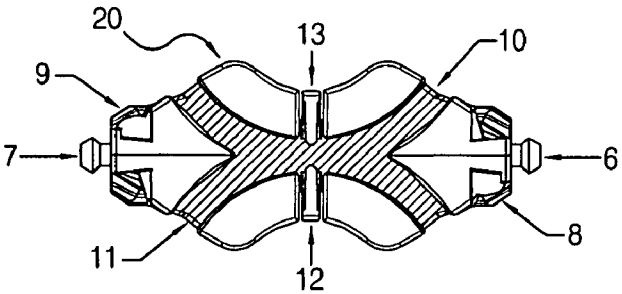
FIG.4
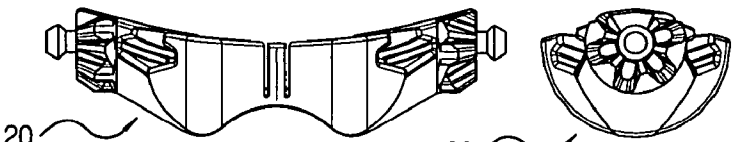
FIG.5
FIG.6
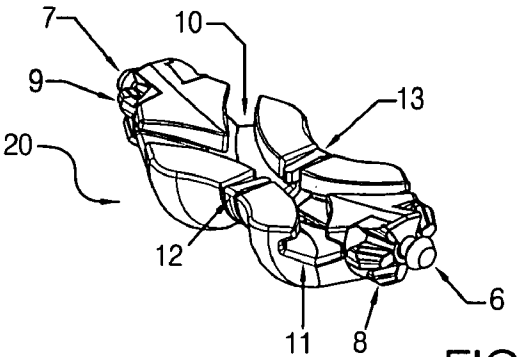
FIG.7

18
8
20
22

20
22
30

32
24
34
40
22
20
30

40
24
25
34
11
32
20
22
27
30

50
52
54
56
58
1
4

52
54
58
50
1
4
56

50
52
32
24
34
40
12
20
30
22
3
1

50
52
24
34
40
12
20
30
1

50
56
24
34
40
20
52
30
1

80
1

TRANSFORMING PUZZLE

This application claims priority of provisional application No. 60/512,419, filed Oct. 17, 2003.

BACKGROUND OF THE INVENTION

Numerous puzzles are based on the principle of "recombination": manipulating pieces along constrained paths to reach a "solution state". A traditional example is the puzzle consisting of fifteen square pieces that can slide along their edges, held in place by a square tray whose sides are four times the length of the squares. As one attempts to move a piece to its desired location, one is forced to move other pieces out of the way which prevent one from achieving the solution directly.

A second famous example is "Rubik's Cube," whereby pieces are twisted around a cubic shape. Again, as one attempts to get certain pieces into a desired location, one is forced to move other pieces.

SUMMARY OF THE INVENTION

A new type of puzzle which shares this basic recombination principal of the prior art, but which also has unique properties that enhance the enjoyment and challenge of solving the puzzle is provided. The concept allows for certain polyhedral shapes, for example a tetrahedron, which may be manipulated in two different ways.

First, through a three-dimensional geared arrangement, the puzzle may be "flipped" from one state to another. This "flipping" takes all of the exposed surfaces of the puzzle and hides them while simultaneously revealing a new set of surfaces. Thus, the puzzle "transforms".

Second, each of the "corners" (vertices) of the polyhedral shape may be twisted in place. By twisting the pieces, the user attempts to match elements of the puzzle to achieve a state whereby each of the four sides of the tetrahedron have a single consistent color.

However, as one manipulates or twists the pieces, one is also inadvertently moving the hidden surfaces. It is only when the puzzle is "flipped" that one discovers the results of one's manipulation for the hidden side.

The unique features of this puzzle are:

- it transforms (changes color) when flipped;
- there are two independent solution states: matching faces by color, and matching vertices by color. Further, a path exists to go from one solution to the other;
- each solution state itself has two "sides", each of which may be alternately revealed by flipping the puzzle.
- it has a novel play pattern whereby manipulation of the puzzle equally affects visible and invisible faces.

A transforming puzzle is therefore disclosed comprised of a multiplicity of geared links that are arranged such that their turning axes are oriented along the edges of a polyhedral shape. By applying a turning force to a single link, all links in the puzzle turn synchronously. There are two end positions of the geared links. In each end position, a set of link groups are formed, each of those groups corresponding to one face of the polyhedral shape. Each link group forms a circular track that is inscribed on that particular face.

When the puzzle is manipulated to a second end position, a new set of new link groups are formed corresponding to a different a different set of faces of the polyhedral shape.

The puzzle is further comprised of a number of "petal elements" equal to the number of geared links which have a faceted form and a base piece that extends from that form, the piece providing sliding contact with the geared links.

Within the assembled puzzle, the petal elements are each held within a corresponding geared link. When the puzzle is in one end position, a group of petals corresponding to a polyhedral face touch each other to form a pyramidal shape such that one-half of their surfaces are exposed and one-half of their surfaces are hidden. As the puzzle is "flipped", i.e. the geared links are turned to their other end position and the petals recombine to hide the previously visible surfaces and to reveal the previously invisible surfaces.

In either end position, the group of petals corresponding to a polyhedral face may be twisted around the center point of that face, thereby changing the correspondence between the geared links and the petal elements.

Accordingly, it is an object of the invention to provide a puzzle design having a plurality of geared links.

Another object of the invention is to provide a puzzle design which may be flipped or rotated between two different states.

A further object of the invention is to provide a puzzle design having a plurality of twistable polyhedral shapes.

Still other objects and advantages of the invention will become apparent from the following description.

BRIEF DESCRIPTION OF THE DRAWINGS

For a fuller understanding of the invention, reference is made to following description, taken in connection with the accompanying drawings, in which:

FIG. 1 is a perspective view of a petal element of the invention;

FIG. 2 is a front elevational view of the petal element of FIG. 1;

FIG. 3 is a side elevational view of the petal element of FIG. 1;

FIG. 4 is top plan view of a single link of the invention;

FIG. 5 is a front elevational view of the link of FIG. 4;

FIG. 6 is a side elevational view of the link of FIG. 4;

FIG. 7 is a perspective view of the link of FIG. 4;

DETAILED DESCRIPTION OF THE PREFERRED EMBODIMENTS

Figures 8, 9, 10, 11, 12, 13:
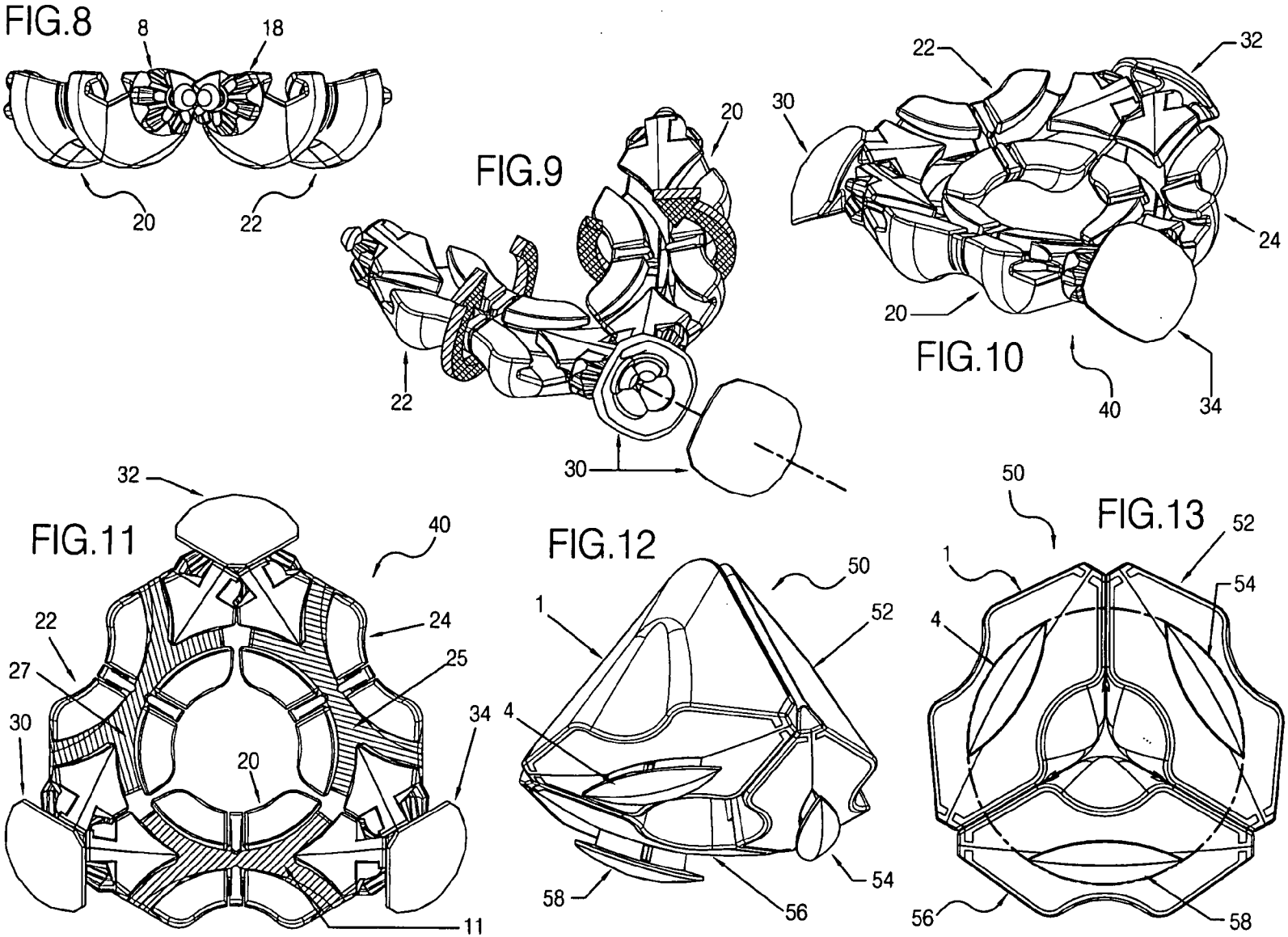
FIG. 8 is a front elevational view of two links of the invention engaged with one another.
FIG. 9 is a front elevational view of the two links of FIG. 8.
FIG. 10 is a perspective view of a linkage assembly in accordance with the invention.
FIG. 11 is a top plan view of the linkage assembly of FIG. 10.
FIG. 12 is a perspective view of three petal elements of the invention.
FIG. 13 is a top plan view of the petal elements of FIG. 12.

FIG. 1 shows a perspective view of element 1, hereinafter referred to as a "petal element", which is comprised of a faceted shape 2 and a supporting base piece 4.

FIG. 2 shows an elevation view of petal element 1. Further shown in this view is detent area 3, a surface concavity which is inscribed into base piece 4. FIG. 3 shows petal element 1 in side elevation.

FIG. 4 shows a plan view of link 20 which is comprised of a central region 10 and two gear ends 8 and 9. Central region 14 has a grooved arcuate track 11 inscribed within it. Track 11 has the shape of two intersecting circular paths. Also contained within region 14 are two flexible prongs 12 and 13.

A pin 6 protrudes from gear end 8, and a second pin 9 protrudes from gear end 7.

FIG. 5 and FIG. 6 show link 20 in front elevation and side elevation views respectively.

FIG. 7 shows a perspective view of link 20.

FIG. 8 shows two links 20 and 22 in proximity to each other such that their respective gear ends 8 and 18 are engaged with one another.

FIG. 9 shows a links 20 and 22 connected to one another via hub element 30 shown here in exploded view. Hub element 30 allows links 20 and 22 to rotate around their respective axes, while maintaining geared engagement between gear ends 8 and 18.

FIG. 10 shows a perspective view of mechanical assembly 40 comprised of three links 20, 22 and 24 which are connected by hubs 30, 32 and 34.

FIG. 11 shows a plan view of assembly 40. Significantly, tracks 11, 25 and 27 belonging, respectively, to links 20, 22 and 24 form a complete circle.

FIG. 12 shows a perspective view of assembly 50 comprised of three petal elements 1, 52 and 56. Also shown are three base pieces 4, 54 and 58 belonging to petal elements 1, 52 and 56 respectively.

FIG. 13 shows a plan view of assembly 50. The perimeter of base pieces 4, 54 and 58 may be seen to form a partial circle as indicated in dashed line.

Figures 14, 15, 16:
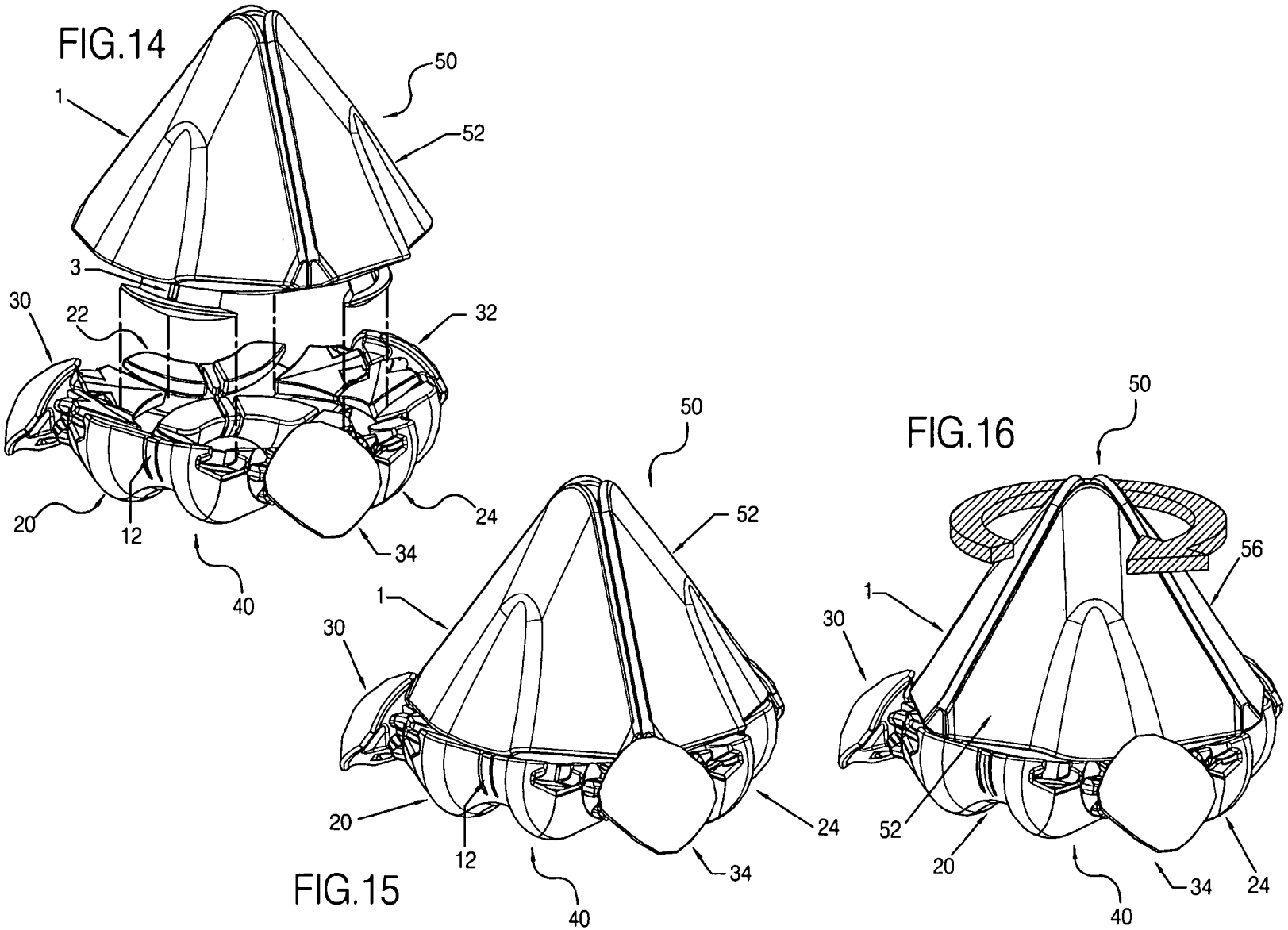
FIG. 14 is an exploded perspective view of a first embodiment of a puzzle assembly of the invention.
FIG. 15 is a front elevational view of the puzzle assembly of FIG. 14.
FIG. 16 is a front elevational view similar to FIG. 15 and showing the assembly being rotated.

FIG. 14 shows assemblies 40 and 50 in proximity to each other. Base pieces 4, 54 and 58 may be engaged within the circular track formed by links 20, 22 and 24. Detent area 3 is directly above flexible prong 12.

FIG. 15 shows assemblies 40 and 50 engaged with one another. Flexible prong 12 presses into detent area 3.

FIG. 16 shows assembly 40 having been rotated around the axis formed by the circular track. Base pieces 4, 54 and 58 are retained within the track formed by links 20, 22 and 24.

Figure 17:
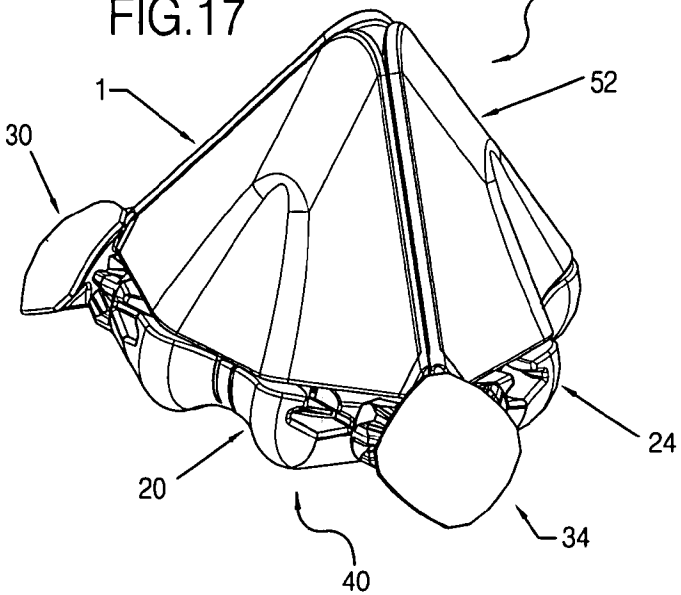
FIG. 17 is an alternative perspective view of the assembly of FIG. 14.

FIG. 17 again shows assemblies 40 and 50 engaged with one another.

Figure 18:
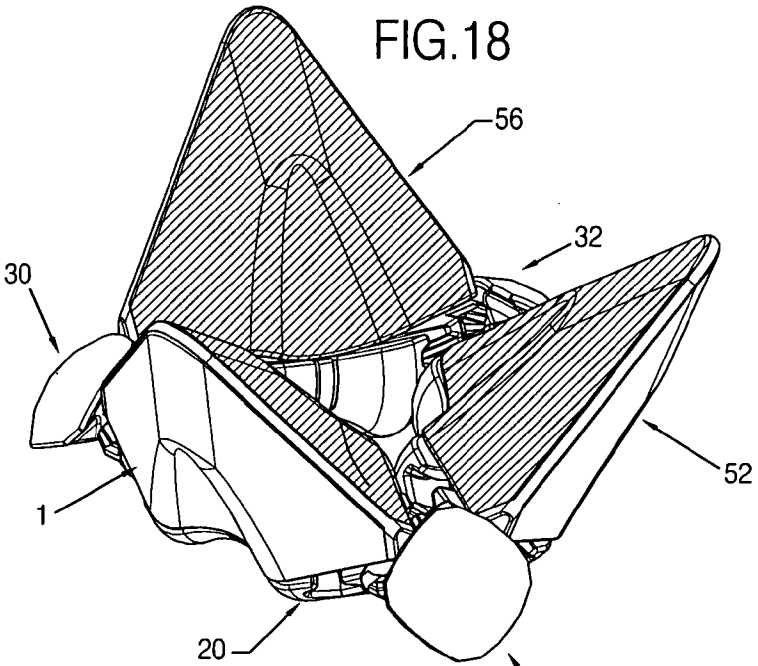
FIG. 18 is a perspective view of the assembly of FIG. 14 in a first locked stated.

FIG. 18 shows link 20 having been rocked about its axis. Petal element 1, which is retained by link 20, has rocked along with link 20. Similarly, petal element 50 retained by link 24 has rocked about that link's axis. Similarly, petal element 56 retained by link 22 has rocked about that link's axis. All three links are constrained to rock together because their respective gear ends are engaged with one another.

Figure 19:
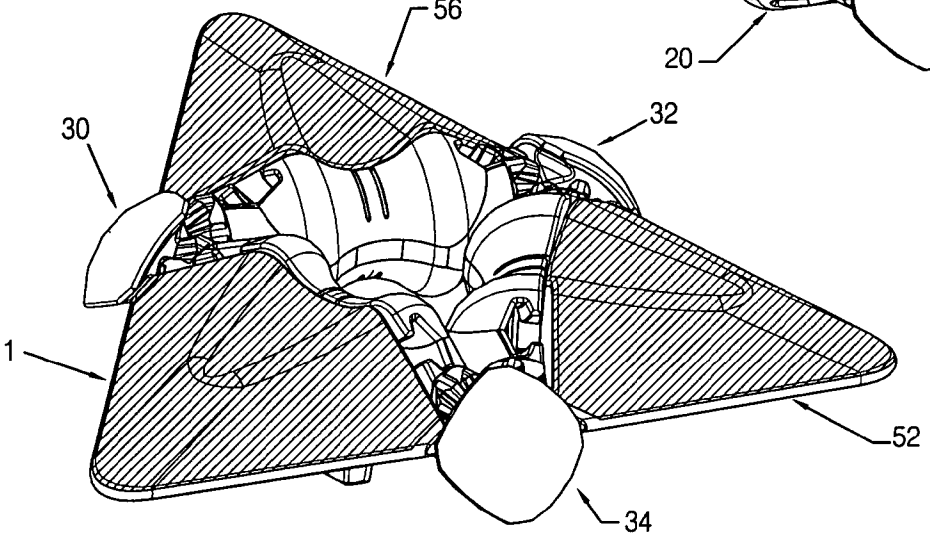
FIG. 19 is a perspective view of the assembly of FIG. 14 in a second further locked state.

FIG. 19 shows links 20, 22 and 24 along with their respective engaged petal elements 1, 50 and 56 having been further rocked such that the opposite side of said petal elements, shown here in shaded form, is exposed.

Figure 20:
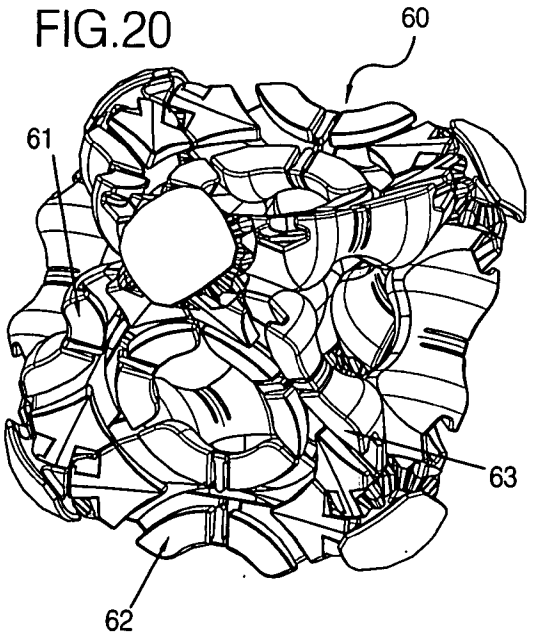
FIG. 20 is a front perspective view of a second embodiment of a linkage assembly of the invention.
Figure 21:
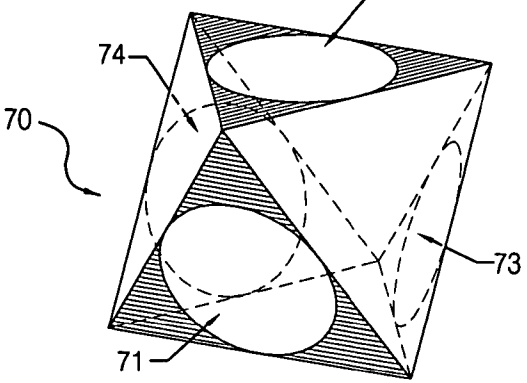
FIG. 21 is an abstracted view of the assembly of FIG. 20.

FIG. 20 shows an assembly 60, which is comprised of twelve links and six hub elements. FIG. 21 shows an abstracted view 70 of assembly 60, which may be seen to have the general form of an octahedron having eight triangular faces. Also shown on view 70 are circles 71, 72, 73 and 74, which are inscribed into alternating faces of the octahedron.

By comparing FIG. 21 with FIG. 20, it may be seen that circle 71 corresponds to a circular track formed by three links 61, 62 and 63 in assembly 60. Likewise, circle 72 corresponds to a circular track formed by three other links in assembly 60. The other two circles correspond to circular tracks that are hidden from view in FIG. 20.

Figure 22:
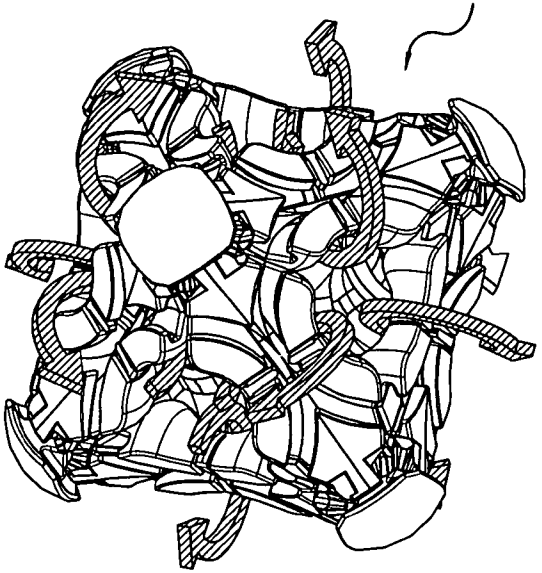
FIG. 22 is a front perspective view of the assembly of FIG. 20 in a reconfigured condition.

FIG. 22 shows assembly 60 in a reconfigured position. All twelve links are in process of being rocked about their respective axes. Their movement is synchronized due to the geared engagement of all neighboring links.

Figure 23:
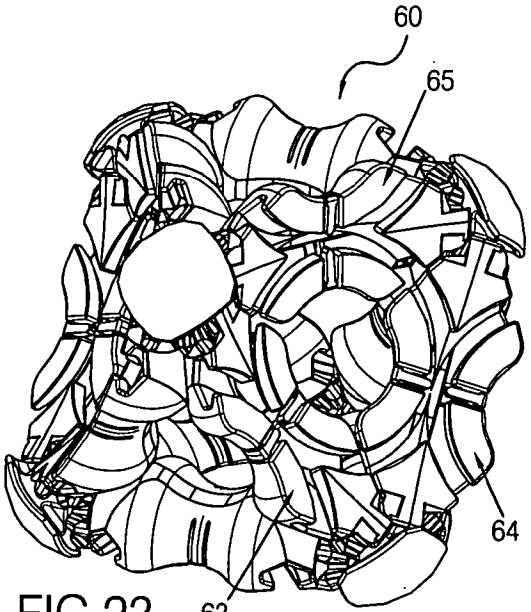
FIG. 23 is a perspective view of the assembly of FIG. 20 in a further reconfigured condition.
Figure 24:
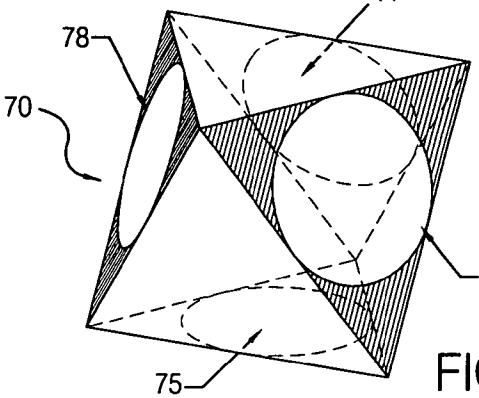
FIG. 24 is an abstracted view of the assembly of FIG. 23.

FIG. 23 shows assembly 60 in another position in which all links have been rocked into a new configuration. FIG. 24 shows an abstracted view 79 of assembly 60. Also shown in view 79 are circles 75, 76, 77 and 78, which are inscribed into alternating faces of the octahedron. These four alternating faces may be seen to be the complement of the faces 71, 72, 73 and 74 shown in FIG. 21.

By comparing FIG. 24 with FIG. 23, it may be seen that circle 76 corresponds to a circular track formed by three links 63, 64 and 65 in assembly 60. Likewise, circle 78 corresponds to a circular track formed by three other links in assembly 60. The other two circles correspond to circular tracks that are hidden from view in FIG. 23.

Figures 25, 26, 27, 28, 29, 30, 31:
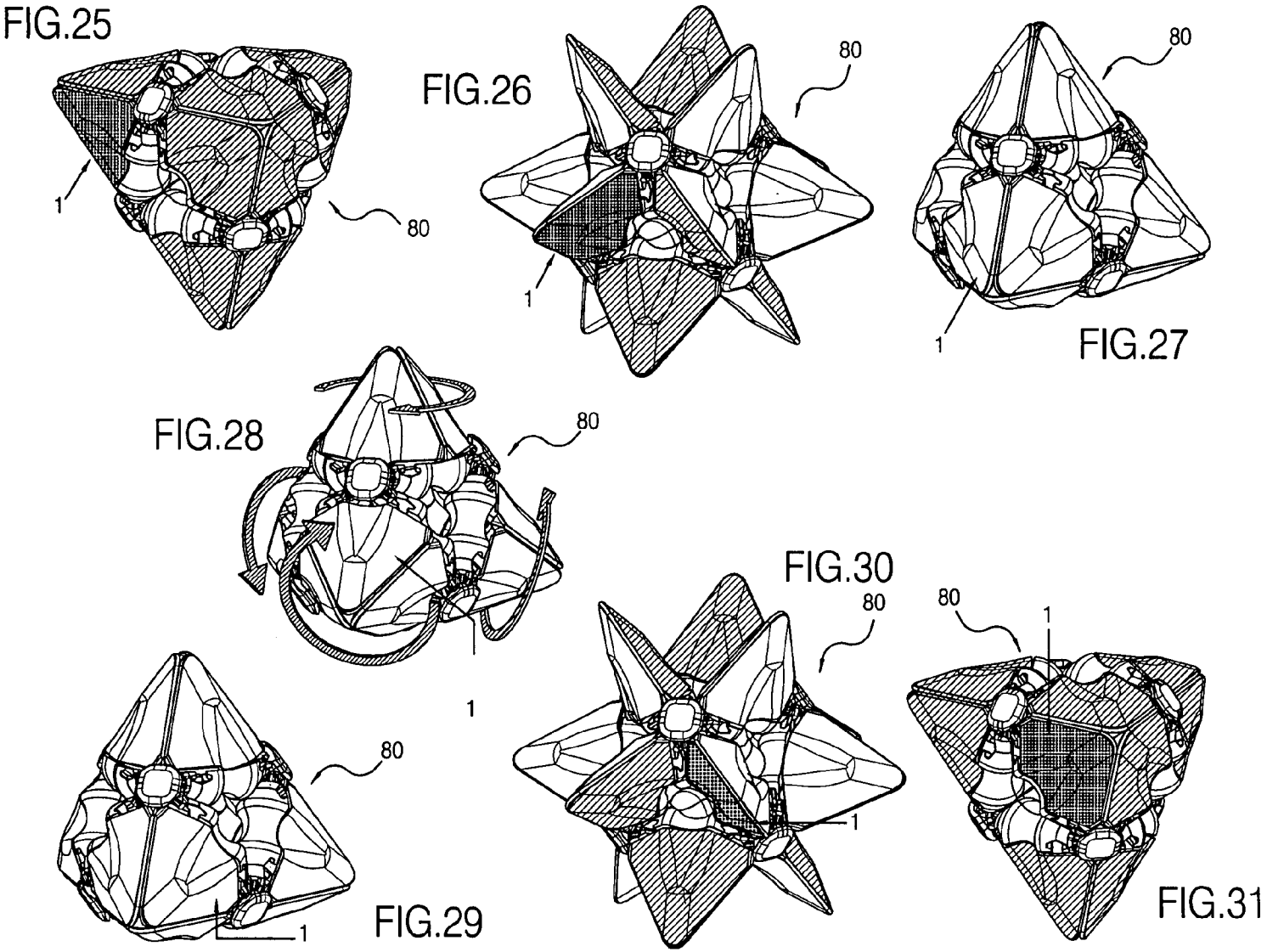
FIG. 25 is a perspective view of a puzzle assembly of another embodiment of the invention and formed utilizing the linkage assembly of FIG. 20.
FIG. 26 is a perspective view of the puzzle assembly of FIG. 25 in a first reconfigured condition.
FIG. 27 is a perspective view of the puzzle assembly of FIG. 25 in which the links have been locked into a second configuration.
FIG. 28 is a perspective view of the puzzle assembly of FIG. 25 having been further reconfigured in condition.
FIG. 29 is a perspective view of the puzzle assembly of FIG. 25 in which all petal elements have been rotated.
FIG. 30 is a perspective view of the puzzle assembly of FIG. 25 in yet a further configured condition.
FIG. 31 is a perspective view of the puzzle assembly of FIG. 25 in still another configured condition after locking.

FIG. 25 shows an assembly 80 which is comprised of twelve links, twelve petal elements and six hub elements. In this position, it has the form of a tetrahedron having four triangular faces. The exposed faces of the twelve petal elements are shaded or colored. Petal element 1 has a darker shading than the other petal elements.

FIG. 26 shows assembly 80 in a reconfigured position. All twelve links, along with their respective engaged petal elements, are in the process of being rocked about their respective axes. Their movement is synchronized due to the geared engagement of all neighboring links.

FIG. 27 shows assembly 80 in another position in which all links have been rocked into a new configuration. The general form of the assembly is again a tetrahedron. However, the exposed faces of the petal elements are now seen to be un-shaded, their shaded faces having been hidden within the assembly. Petal 1 may be seen to be in a different position relative to FIG. 25.

FIG. 28 shows assembly 80 being further reconfigured. Four groups of three petal elements each are being rotated around the circular tracks that retain them. Thus, all of the petal elements are in process of being repositioned relative to the assembly of links and hubs. In particular, petal 1 is shown being rotated into a new position.

FIG. 29 shows assembly 80 after having had all of its petal elements rotated, with petal 1 in its new position.

FIG. 30 shows assembly 80 again being reconfigured; all twelve links, along with their respective engaged petal elements, are in the process of being rocked about their respective axes.

Finally, FIG. 31 shows assembly 80 in another position in which all links have been rocked into a new configuration. Petal 1 is now in an entirely different position from its starting point shown in FIG. 27. By a continuing sequence of rocking (or "flipping") and then rotating (or "twisting") the petals in groups of three around their circular tracks, the assembly may be continually reconfigured.

Further, each petal element may be given a particular color such that the petals form an organized visually complementary pattern when the assembly is in a "closed" or tetrahedral form. When the assembly is manipulated by a series of "flips" and "twists," the relative location of the petals is scrambled into a seemingly random configuration.

The assembly is thus a manipulative puzzle in that it may be easily scrambled. The goal of the puzzle play is to retrieve its original organized pattern of colors.

Figure 33:
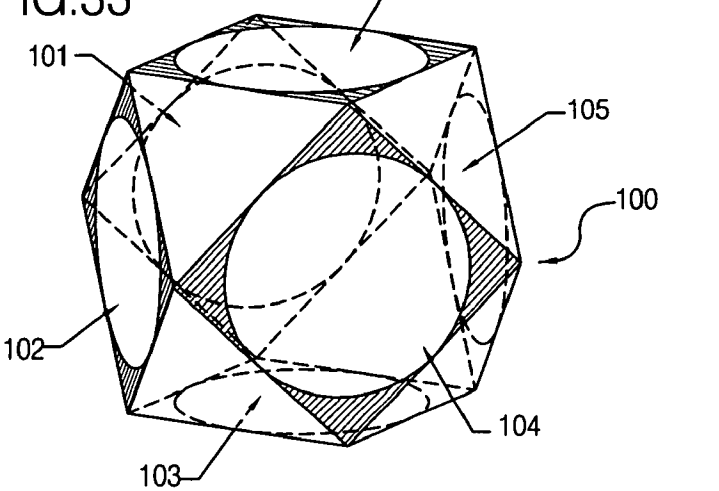
FIG. 33 is an abstracted view of the assembly of FIG. 32.
Figure 32:
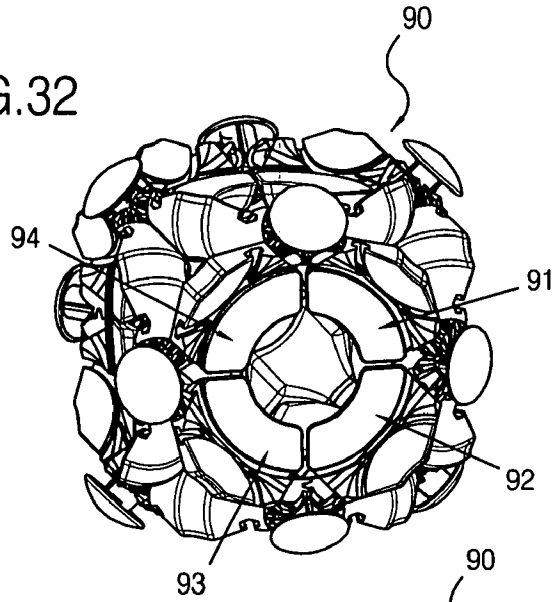
FIG. 32 is a front perspective view of a further embodiment of a linkage assembly made in accordance with the invention.

FIG. 32 shows an assembly 90 which is comprised of twenty-four links and twelve hub elements. FIG. 33 shows an abstracted view 100 of assembly 90 which may be seen to have the general form of an cuboctahedron having eight triangular faces and six square faces. Also shown on view 100 are circles 101, 102, 103, 104 105 and 106, which are inscribed into the six square faces of the cuboctahedron.

By comparing FIG. 33 with FIG. 32, it may be seen that circle 104 corresponds to a circular track formed by four links 91, 92, 93 and 94 in assembly 90. Likewise, each circle corresponds to circular tracks formed by a set of link groups, each comprised of four links within assembly 90.

Figure 35:
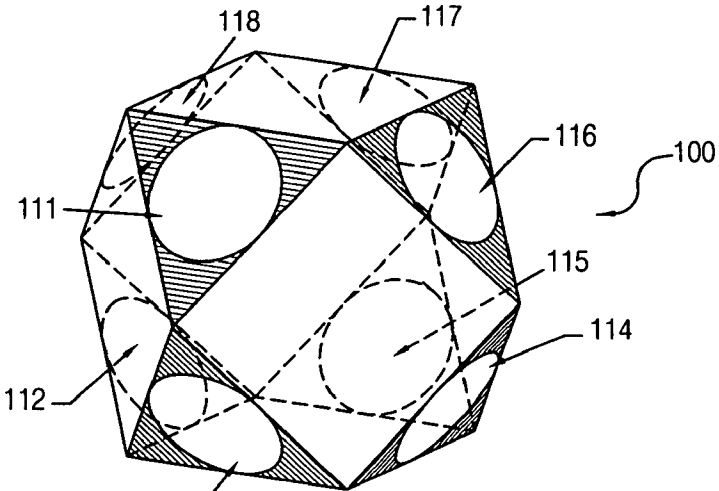
FIG. 35 is an abstracted view of the assembly of FIG. 34.
Figure 34:
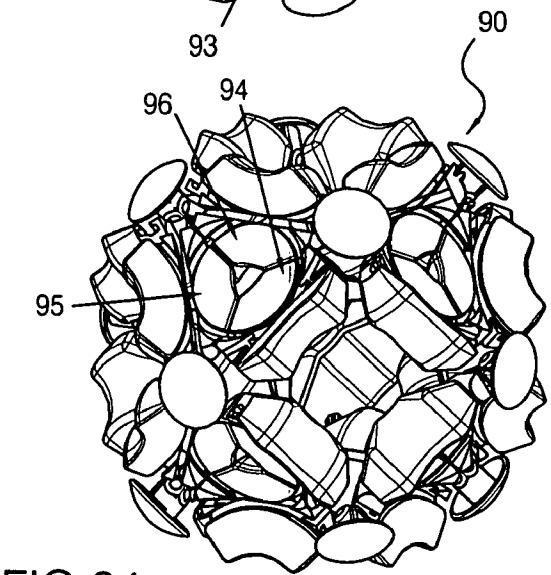
FIG. 34 is a front perspective view of the linkage of FIG. 32 locked into a new condition state.

FIG. 34 shows an assembly 90, in which all of its links have been rocked into a new end position. FIG. 35 shows an abstracted view 100 of assembly 90, again having the general form of an cuboctahedron. Also shown on view 100 are circles 111, 112, 113, 114, 115, 116, 117 and 118 which are inscribed into the eight triangular faces of the cuboctahedron.

By comparing FIG. 35 with FIG. 34, it may be seen that circle 111 corresponds to a circular track formed by four links 95, 96, 97 and 98 in assembly 90. Likewise each circle corresponds to circular tracks formed by a set of link groups, each comprised of four links within assembly 90.

Figure 36:
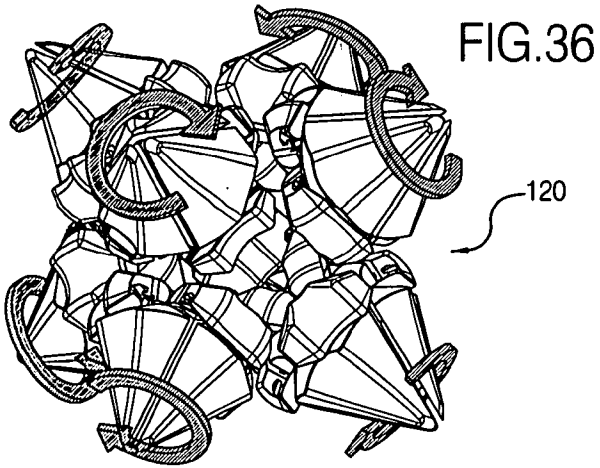
FIG. 36 is a front perspective view of a puzzle assembly incorporating the linkage of FIG. 32.

FIG. 36 shows a puzzle assembly 120 which is comprised of assembly 90 and twenty-four petal elements which are retained by the twenty-four links in the assembly. In this configuration, eight sets of three petals are in process being turned around the circular tracks within the links, those sets corresponding to the eight vertices of a cube.

Figure 37:
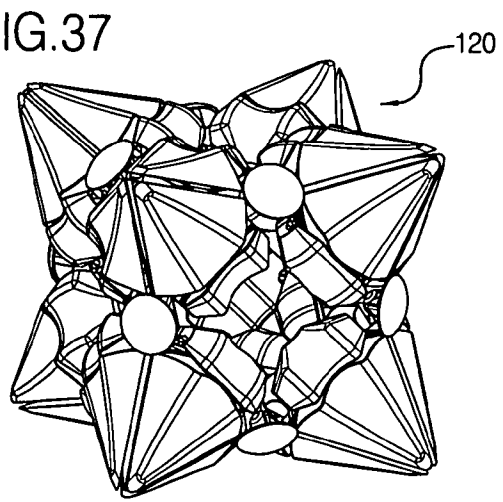
FIG. 37 is a front perspective view of the puzzle assembly of FIG. 36 in a first locked condition.
Figure 38:
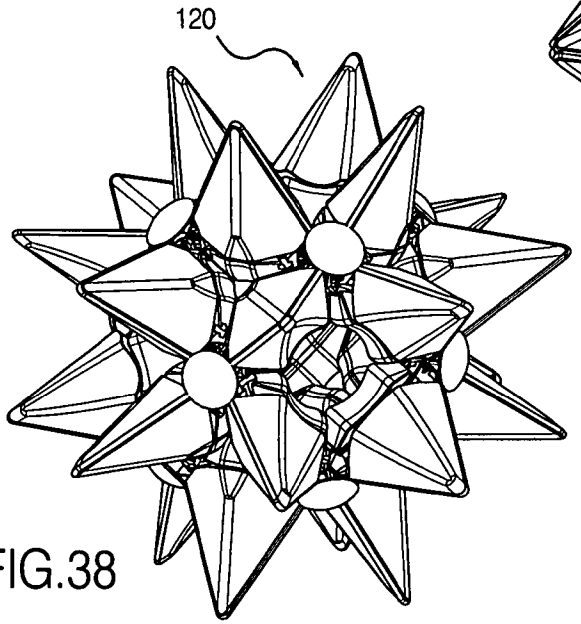
FIG. 38 is a front perspective view of the puzzle assembly of FIG. 36 in an open condition.
Figure 39:
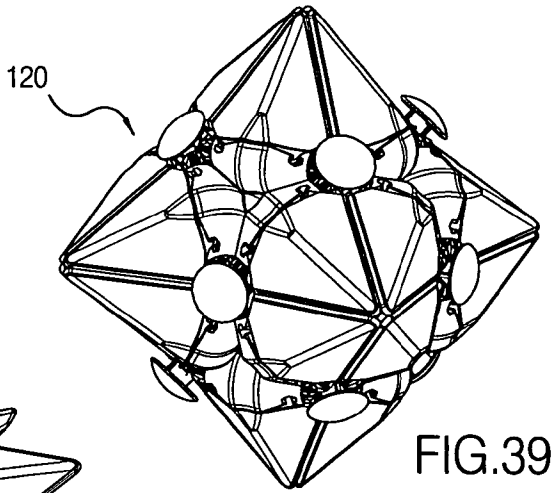
FIG. 39 is a perspective view of the puzzle assembly of FIG. 36 in a second locked condition.

FIGS. 37, 38 and 39 show assembly 120 being repositioned to a new end position in which each of the twenty-four links, with its corresponding petal element is being rocked. Whereas assembly 120 has a generally cubic form in FIG. 37, it has a generally octahedral form in FIG. 39.

Figure 40:
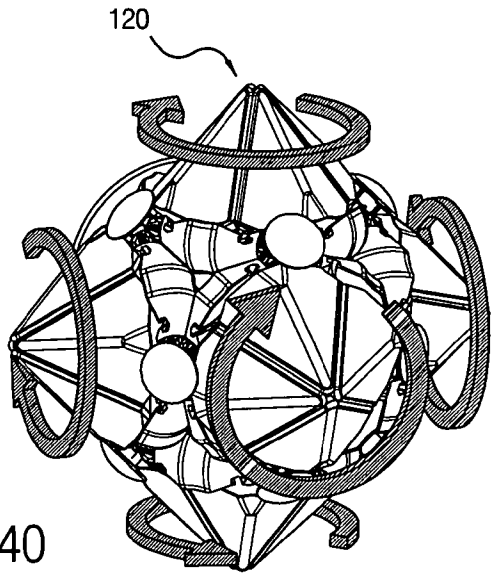
FIG. 40 is a front perspective view of the assembly of FIG. 36 in which the petal elements are being rotated.

FIG. 40 shows six sets of four petals, each in the process of being turned around the circular tracks within the links, with those sets corresponding to the six vertices of an octahedron.

Figure 41:
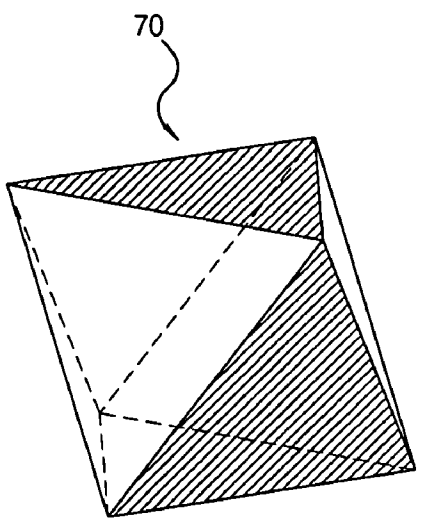
FIG. 41 is a front perspective view of the underlying shape of the puzzle assembly of FIGS. 20–31.

FIG. 41 shows the underlying shape 70 of the puzzle corresponding FIGS. 20–31, that shape being an octahedron.

Figure 42:
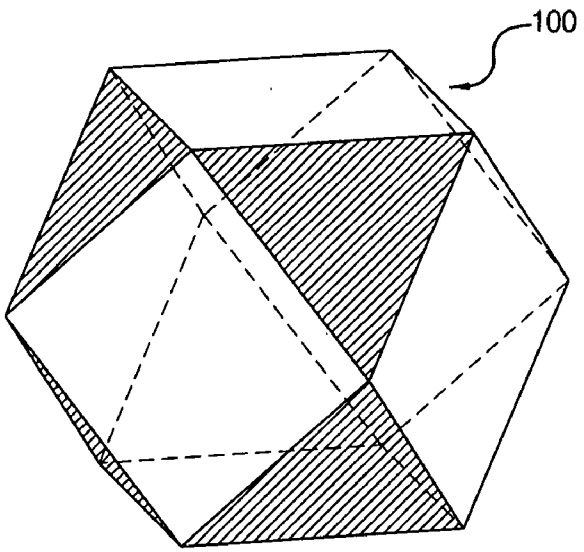
FIG. 42 is a perspective view of the underlying shape of the puzzle assembly of FIGS. 32–40.

FIG. 42 shows the underlying shape 100 of the puzzle corresponding FIGS. 32–40, that shape being an octahedron.

Figure 43:
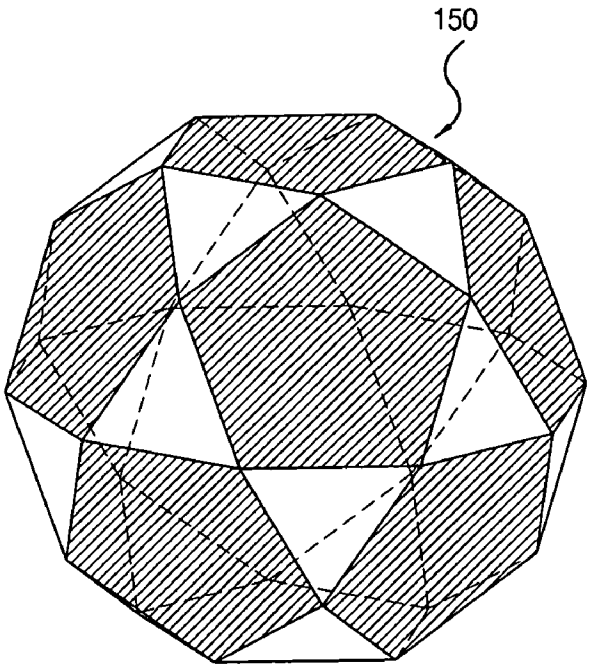
FIG. 43 is a perspective view of the underlying shape of yet a further type of puzzle assembly made in accordance with the invention.

FIG. 43 shows the underlying shape 150 of another possible configuration of the puzzle, that shape being an icosadodecahedron.

Thus, the inventive linkage assemblies and puzzle systems produced therefrom are consistent with the objects of the invention. The scope of the invention is defined in the claims.

Moreover, other embodiments are suitable for meeting the inventive objects without departing from the spirit and scope of the inventive concept.

The invention claimed is:

1. A mechanical linkage assembly for a puzzle comprising a plurality of links, each having first and second geared ends, and interconnecting hub elements for connecting the first geared end of one link to the second geared end of another link;

wherein all of said connected links simultaneously axially rotate about said hubs between two axial rotated states;

wherein each said link includes a first grooved arc such that said first grooved arcs of said connected links together define a first circular track only when said connected links are in said first axial rotated state.

2. The linkage of claim 1, wherein each of said link further includes a second substantially oppositely directed grooved arc such that said second grooved arcs of said connected links together define a second circular track only when said connected links are in said second axial rotated state.

3. The assembly of claim 2, wherein said first and second grooved arcs of each said link at least partially intersect.

4. The assembly of claim 3, further including a plurality of petal elements which correspond in number to that of said links and collectively rotatably twistable with respect to said connected links only when said links are in said first and second axial rotated states.

5. The assembly of claim 4, wherein each of said petal elements is slidably supported in said first circular track when said connected links are in said first axial rotated state and slidably supported in said second circular track when said connected links are in said second axial rotated state.

6. The assembly of claim 4, wherein each said petal element has a first face and a second opposite face.

7. The assembly of claim 6, wherein, for each petal element, the first face is exposed and the second face is hidden when said connected links are in said first axial rotated state.

8. The assembly of claim 7, wherein for each said petal, the second face is exposed and the first face is hidden when said connected links are in said second axial rotated state.

9. The assembly of claim 4, wherein said first faces of said plurality of petal elements together define a polyhedral shape when said links are in said first axial rotated state.

10. The assembly of claim 9, wherein said second faces of said plurality of petal elements together define a second polyhedral shape when said links are in said second axial rotated state.

11. The assembly of claim 6, wherein said first face of any of said petal elements has an aesthetic appearance different from that of said second face.

12. The assembly of claim 11, wherein said first face defines a first color and said second face defines a second color.

13. The assembly of claim 11, wherein said aesthetic appearances of said first faces are visually complementary to each other.

14. The assembly of claim 13, wherein said aesthetic appearances of said second faces are visually complementary to each other.

15. A transforming puzzle system comprising:

a mechanical linkage comprising a plurality of interconnected links, said links having geared ends and being simultaneously axially rotatable between first and second axial rotated states;

a plurality of petal elements corresponding in number to that of said links and collectively rotatably twistable with respect to said links only when said links are in said first and second axial rotated states.

16. The system of claim 15, further including hub elements for connecting one geared end of a first link element to one geared end of a second link element.

17. The system of claim 16, wherein each said link includes a first grooved arc such that said first grooved arcs of said connected links together define a first circular track only when said connected links are in said first axial rotated state.

18. The system of claim 17, wherein each of said links further includes a second substantially oppositely directed grooved arc such that said second grooved arcs of said connected links together define a second circular track only when said connected links are in said second axial rotated state.

19. The system of claim 18, wherein said first and second grooved arcs of each said link at least partially intersect.

20. The system of claim 19, wherein each of said petal elements is slidably supported in said first circular track when said connected links are in said first axial rotated state and slidably supported in said second circular track when said connected links are in said second axial rotated state.

21. The system of claim 15, wherein each said petal element has a first face and a second opposite face.

22. The system of claim 21, wherein, for each petal element, the first face is exposed and the second face is hidden when said connected links are in said first axial rotated state.

23. The system of claim 22, wherein for each said petal, the second face is exposed and the first face is hidden when said connected links are in said second axial rotated state.

24. The system of claim 15, wherein said first faces of said plurality of petal elements together define a polyhedral shape when said links are in said first axial rotated state.

25. The system of claim 24, wherein said second faces of said plurality of petal elements together define a second polyhedral shape when said links are in said second axial rotated state.

* * * * *